US010240814B1

(12) United States Patent
Lesage

(10) Patent No.: US 10,240,814 B1
(45) Date of Patent: Mar. 26, 2019

(54) DOUBLE GLASS COATED TANK FOR HIGH TEMPERATURE WATER HEATERS

(71) Applicant: MICLAU-S.R.I. INC., Montreal East (CA)

(72) Inventor: Claude Lesage, Pointe Claire (CA)

(73) Assignee: MICLAU—S.R.I.INC., Montreal, QC (CA)

( * ) Notice: Subject to any disclaimer, the term of this patent is extended or adjusted under 35 U.S.C. 154(b) by 0 days.

(21) Appl. No.: 15/732,140

(22) Filed: Sep. 25, 2017

(51) Int. Cl.
*F22B 31/00* (2006.01)
*F24H 1/18* (2006.01)
*C23D 5/04* (2006.01)

(52) U.S. Cl.
CPC ..... *F24H 1/183* (2013.01); *C23D 5/04* (2013.01)

(58) Field of Classification Search
CPC ..... F22B 31/00
See application file for complete search history.

(56) References Cited

U.S. PATENT DOCUMENTS 5,855,747 A * 1/1999 Lusk ..... C23F 13/00 204/196.19
6,303,183 B1 * 10/2001 Wilczynski ..... A01N 25/08 427/193
7,410,672 B2 * 8/2008 Waters ..... C03C 8/06 427/376.2
2016/0194764 A1 * 7/2016 Patel ..... C23D 5/04 427/591

* cited by examiner

*Primary Examiner* — Gregory A Wilson
(74) *Attorney, Agent, or Firm* — Guy J. Houle; Houle Patent Agency Inc.

(57) ABSTRACT

A double glass coated steel tank for a high temperature water heater and its method of fabrication is described. The tank is constructed of steel welded parts and fittings are secured to the tank without the presence of sharp edges being formed on the inner surface of the tank not to form any weakness in the composite glass coating to be applied. A first water resistant base coat of cobalt glass enriched with ZIRCON (trademark) is applied to the inner surface and the tank is heat fired at a high temperature in the order of about 1600 degrees F. A second high temperature water resistant glass coat, having a fine gas bubble size not exceeding 10 microns, is applied over the first coat and the tank is heat fired a second time. The composite glass coating thus formed is highly water and corrosion resistant in a water environment of up to at least 190 degrees F.

9 Claims, 2 Drawing Sheets

DOUBLE GLASS COATED TANK FOR HIGH TEMPERATURE WATER HEATERS

FIELD OF THE INVENTION

The present invention relates to high temperature water heaters and more specifically to a double glass coated steel tank for use with such water heaters and which is highly water resistant and corrosion resistant and its method of fabrication.

High temperature water heaters are known to increase the ability of a water heater to supply a larger quantity of hot water as an alternative to increasing the volume of the tank. Increasing the volume of the tank is more expensive and requires a larger space for installation and this is not desirable, particularly for use in small apartments and condo dwellings where space is limited. In order to operate the water heater at higher temperatures, without the risk of scalding the user person, the hot water drawn from the tank, usually at a high temperature of about 180 degrees F., is mixed in a mixing valve with the cold household water supply before it is directed to the hot water distribution system. For safety reasons, a temperature detecting safety shut off valve can also be installed downstream of the mixing valve to shut off the hot water supply should the mixing valve be defective.

When operating a water heater at such high temperature, it is also desirable to have a control whereby to heat the water to such high temperature during off-peak hours when the energy is at a much lower cost than during peak hours. This results in a cost saving to the consumer and a reduction of the load on the grid during peak hours when there is a greater demand for energy. By reducing the demand during peak hours the risk of overloading the grid is also reduced which is a benefit to the energy supplier.

Another advantage of operating a water heater at high temperature is to ensure that the consumer has a sufficient supply of hot water permitting the use of larger volumes of hot water which is desirable such as when filling a bath tub, for example. It is also desirable to have ample hot water when hot water consuming appliances are operating at the same time, for example a dishwasher and a shower wherein the person in the shower is not subjected to an abrupt water temperature change due to a lank of hot water. When hot water is drawn from the tank, it is replaced by cold water which is released to the bottom of the tank and this causes the water in the tank to gradually fall in temperature. Also, the heating elements or the burner for a gas-fired water heater does not become activated until the water temperature falls to a preset low temperature of the water in the tank which is often set much lower than the high temperature set point. By maintaining the water temperature at a much higher temperature than the conventional temperature of about 120 to 140 degrees F., this problem can be greatly reduced.

It is known that the high temperature water in the tank of a water heater causes the glass lining on the inner surface of the tank to slowly dissolve and particularly so in areas where the coating is thinner such as in the areas of fittings where there are sharp edges where the glass lining is thinner because of sharp edges and the risk of exposing the steel tank to the water is greatest. The higher is the temperature of the water in the tank, the higher is the risk of dissolving of the glass coating in its weak areas. In my U.S. Pat. No. 8,869,399 there is described a method of eliminating these sharp edges with the inner surface of the tank.

SUMMARY OF THE INVENTION

It is a feature of the present invention to provide an improved steel tank for use with high temperature water heaters and wherein the tank has a double glass coat on the inner surface thereof which is highly water resistant to water at temperatures of at least up to 190 degrees F. and wherein the outer glass coat has a fine bubble size not exceeding 10 microns.

Another feature of the present invention is to provide an improved steel tank for use with high temperature water heaters and wherein the tank is provided with fittings and steel parts connections which protrudes to the inner surface of the tank and form smooth edges with the inner surface whereby a double glass coat can be fired over the inner surface and the smooth edges to provide a double coat of substantially constant thickness throughout.

Another feature of the present invention is to provide a method of fabricating a high temperature water heater steel tank having a double glass coating on the inner surface thereof and which coating is substantially of constant thickness throughout.

According to the above features, from a broad aspect, the present invention provides a high temperature water heater which is comprised of a steel tank for holding a predetermined volume of water to be heated. Heating means is associated with the steel tank to heat water therein to a temperature up to about 190 degrees Fahrenheit. The tank is constructed of steel welded parts and has fittings secured thereto. The steel tank has an inner surface wherein the fittings and connected parts form smooth edges with the inner surface of the tank to create a smooth inner surface. The smooth inner surface is coated with a first water resistant base coat of a glass primer cobalt enriched with ZIRCON (trademark) which is heat fired, and a second high temperature water resistant glass coat is applied over the first coat and subjected to a second firing producing a hard glass outer surface which is highly water and corrosion resistant and wherein the second glass coat has a fine gas bubble size not exceeding 10 microns.

According to another broad aspect of the present invention there is provided a method of fabricating a water heater steel tank for the containment of a predetermined volume of water to be heated to a temperature of up to about 190 degrees F. The method comprises the following steps:

i) constructing the tank from steel parts welded together and including the securement of fittings thereto. The fittings and connected steel parts extend to an inner surface of the tank and form smooth edges with the inner surface;

ii) applying a first water resistant glass primer cobalt enriched with ZIRCON (trademark) primer base coat to the inner surface and firing the tank with the glass coat primer at a high temperature to adhere the glass coat primer to the inner surface;

iii) applying a second high water temperature resistant glass coat over the first water resistant cobalt base glass primer coat and firing the tank with the second coat to adhere the second coat over the first coat to form a smooth double glass coated tank inner surface which is highly water resistant and corrosion resistant.

BRIEF DESCRIPTION OF THE DRAWINGS

A preferred embodiment of the present invention will now be described with reference to the accompanying drawings in which.

DETAILED DESCRIPTION OF THE PREFERRED EMBODIMENT

Figure 1:
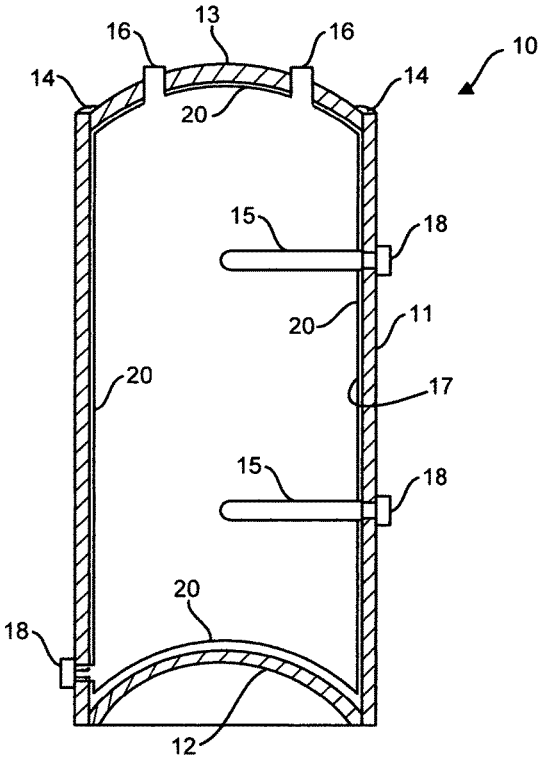
FIG. 1 is a simplified cross-sectional view of a double glass coated steel tank constructed in accordance with the present invention and for the containment of water to be heated to a high temperature of up to about 190 degrees F.

With reference now to the drawings, and more particularly to FIG. 1, there is schematically illustrated a water heater steel tank 10 modified in accordance with the present invention for use in a high temperature water heater where water is to be heated to a temperature up to about 190 degrees F. The tank may be used for the construction of domestic or commercial water heaters. The tank 10 is comprised of a cylindrical sidewall 11, a dome shape bottom wall 12 and a dome shaped top wall 13 all constructed from steel and secured together by welds 14, a few being shown herein. As herein illustrated, the tank is for use as an electric water heater and water within the tank is heated by resistive heating elements 15 secured to fittings 18. The heating means may also be constituted by a burner positioned under the dome shaped bottom wall in a combustion chamber and with a central flue, not shown, extending vertically through the tank to exit through the top wall 13.

Fittings 16 are mounted on the top wall 13 and extend to the inner surface 17 of the tank to receive pipes, not shown, for the extraction of hot water from the top of the tank and to admit a cold water dip tube, not shown but obvious to a person skilled in the art, which extends close to the bottom of the tank to supply water thereto. Other fittings 18 are mounted to the tank side wall and project to the inner surface to permit the mounting of resistive heating elements 15 or for other reasons. The tank inner surfaces 17 including the side wall 11, bottom wall 12 and top wall 13 are covered with a double glass coating 20.

Figure 2:
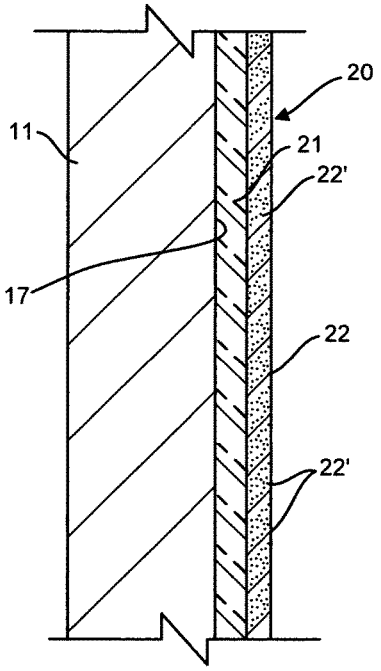
FIG. 2 is a cross-section view of a portion of the sidewall of the steel tank illustrating the double glass coating.

FIG. 2 illustrates the double glass coating 20 and it consists of a first water resistant base coat 21 of cobalt glass enriched with ZIRCO (trademark) which is heat fired with the tank at a temperature of about 1600 degrees F. to fuse the glass coat to the tank inner surface 17. This coat of glass is not brittle and it is of a type commonly referred to as "blue glass" and the coat has a thickness in the order of about 9 to 10 thousands of an inch (0.009 to 0.012). After the firing of the first coat 21, a second coat 22 of a high temperature water resistant glass commonly referred to as "red glass" is applied over the first coat and the tank is subjected to a second high temperature firing to fuse to the first coat. The second coat has very fine gas bubble 22' of sizes not exceeding 10 microns and which are much smaller than the bubble sizes of the first glass coat and has a thickness in the order of about 0.008 on an inch and such constituting a hard glass coating. The second coat provides a protective barrier over the first coat and thereby greatly increases the corrosion resistance of the tank. Because steel looses some strength when subjected to high temperatures, for high water temperature applications of the tank it is constructed of thicker steel or a higher yield steel and in the preferred embodiment a high strength alloy, such as an RP45 steel alloy of Dofasco Steel is used and maintains adequate tensile strength after the double firing. Also, for high water temperature applications it is important to have a high strength alloy to minimize expansion and contraction. The double glass lining described above will not crack when used with the proper high yield steel such of the type mentioned above.

Figure 3:
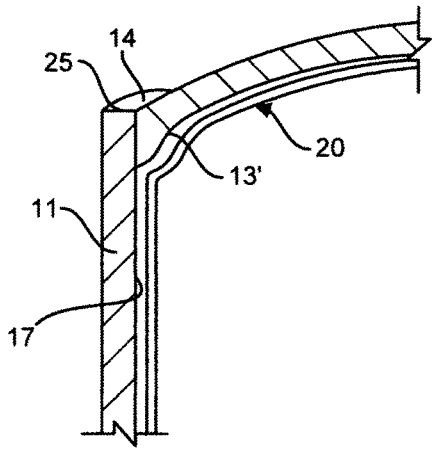
FIG. 3 is a fragmented cross-section view illustrating the connection of the dome-shaped top wall of the tank secured to the cylindrical side wall and the uniformity of the double glass coat in the intersecting region of the connection.
Figure 4:
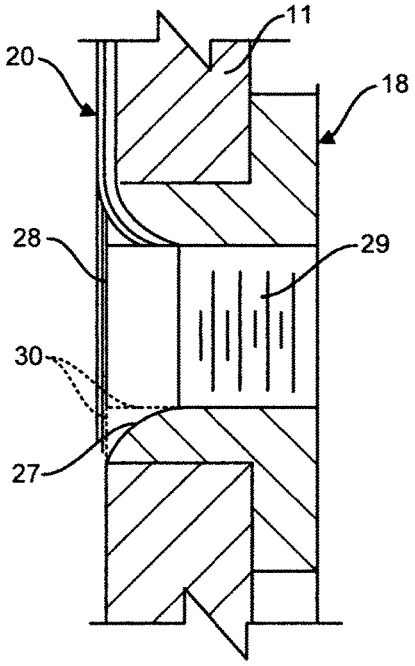
FIG. 4 is a fragmented view illustrating a bushing secured to the tank side wall and formed to present a smooth surface at its intersection with the inner surface of the tank to eliminate any sharp edges under the double glass coating.

As mentioned above, it is important that the double glass coating 20 be of substantially constant thickness throughout the inner surface of the tank side wall, bottom wall and top wall and in the area of the fittings, such as the fittings 16 and 18. FIGS. 3 and 4 illustrates some features of the tank construction to prevent any sharp edges being present in the tank inner surface 17. As shown in FIG. 3 the top wall 13 is welded about the top edge 25 of the cylindrical side wall 11 by the weld 14 located outside the tank. Also, the inner peripheral edge 13' of the top wall 13 is rounded off to present a smooth merging area with the inner surface 17 of the side wall 11. This eliminates any sharp peripheral edge formed by the top wall at its merging area with the side wall 11 and permits the glass coatings 20 to form a smooth transition coating in that area, as herein illustrated.

FIG. 4 shows a coupling type fitting 18 for the connection of the resistive heating elements 15 and has herein illustrated it is formed with a machined smoothly curved inner radius 27 merging from its lower end edge 28 to its threaded bore 29 thereby eliminating the sharp inner edge of the bore as illustrated by phantom lines 30. As herein shown, the double glass coating 20 is shown on only one side of the coupling whereby to illustrate the sharp corner 30 that as been eliminated whereby to form a smooth coating over an exposed portion of the inner radius 27. Of course, a plug is inserted in the coupling prior to coating and firing to protect the threaded portion 29 from the glass coatings.

The method of fabricating the water tank 10 of the present invention can be summarized as follows. Firstly, it is important to construct the tank whereby there are no abrupt transition areas in the inner surface 17 of the tank at its junctures of its welded parts, namely the side wall 11 with the bottom wall 12 and the top wall 13. Also, the fittings 16 and couplings 18 and others not illustrated must not form sharp abrupt areas with the tank inner surface 17. The first water resistant cobalt base glass coat primer "blue coat" is applied to a thickness in the order of from about 0.009 to 0.012 of an inch and the tank is fired to a temperature of about 1600 degrees F. to adhere the first coat to its inner surface. The second glass coat "red coat" is applied over the first coat to a thickness of about 0.008 of an inch and the tank is again fired. This results in a smooth double glass coated tank inner surface which is highly water resistant and corrosion resistant.

It is within the ambit of the present invention to cover any modifications of the preferred embodiment disclosed herein provided such modifications fall within the scope of the appended claims.

The invention claimed is:

1. A high temperature water heater comprising a steel tank for holding a predetermined volume of water to be heated, heating means associated with said steel tank to heat water therein to a temperature up to about 190 degrees Fahrenheit, said tank being constructed of steel welded parts and having fittings secured thereto, said steel tank having an inner surface wherein said fittings and steel welded parts form smooth edges with said inner surface to create a smooth inner surface, said smooth inner surface being coated with a first water resistant base coat primer of cobalt glass enriched with ZIRCON (trademark) which is heat fired, and a second high temperature water resistant glass coat which is subjected to a second firing and produces a hard outer glass surface which is highly water and corrosion resistant and has fine gas bubble sizes not exceeding 10 microns, said fine bubble sizes being constituted by a mixture of gas bubbles in the range of from 1 to 10 microns, and wherein said first water resistant glass primer cobalt base coat having larger gas bubble sizes than said second glass coating, said first and second coatings being resistant to dissolving at said water temperature of up to about 190 degrees F.

2. The high temperature water heater as claimed in claim 1 wherein said first water resistant base coat primer of cobalt glass enriched with ZIRCON (trademark) is of a type commonly referred to as "blue glass" and has a thickness of about 0.009 to 0.012 inches (9 to 12 thousands of an inch).

3. The high temperature water heater as claimed in claim 1 wherein said second high water resistant glass coat is of a type commonly referred to as "red glass" and has a thickness of about 8 mm.

4. The high temperature water heater as claimed in claim 1 wherein said first and second glass coatings and said tank are fired at a temperature in the order of about 1600 degrees F.

5. The high temperature water heater as claimed in claim 1 wherein said steel welded parts are constructed from a high strength RP45 alloy of Dofasco Steel and capable of being subjected to a double firing for the application of said first and second glass coatings while maintaining a desired tensile strength for use in the construction of said high temperature water heater.

6. The high temperature water heater as claimed in claim 5 wherein said steel welded parts, after said double firing, are capable of resisting to pressures up to at least 300 psi.

7. The high temperature water heater as claimed in claim 1 wherein said water heater is one of a domestic water heater and a commercial water heater.

8. The high temperature water heater as claimed in claim 1 wherein said heating means is one of a gas burner for a gas-fired water heater and resistive heating elements for an electric water heater.

9. A method of fabricating a water heater steel tank for the containment of a predetermined volume of water to be heated to a temperature of up to about 190 degrees F., said method comprising the steps of:

i) constructing said tank from steel parts welded together and including the securement of fittings thereto, said fittings and steel parts extending to an inner surface of said tank and forming smooth edges with said inner surface, ii) applying a first water resistant base coat primer of cobalt glass enriched with ZIRCON (trademark) to said inner surface and firing said tank with said glass coat primer at a high temperature to fuse said glass coat primer to said inner surface, and iii) applying a second high water temperature resistant glass coat over said first water resistant cobalt base glass primer coat and firing said tank again with said second coat to fuse said second coat over said first coat to form a smooth double glass coated tank inner surface wherein the second coat has a fine gas bubble size not exceeding to microns and which inner surface is highly water and corrosion resistant in water environment of up to at least 190 degrees F.

* * * * *